US012313270B2

(12) United States Patent
DeRossett

(10) Patent No.: US 12,313,270 B2
(45) Date of Patent: May 27, 2025

(54) WINDOW AIR CONDITIONING UNIT RETENTION BRACKET

(71) Applicant: Midea Group Co., Ltd., Foshan (CN)

(72) Inventor: Andrew Q. DeRossett, Shelbyville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 355 days.

(21) Appl. No.: 18/067,403

(22) Filed: Dec. 16, 2022

(65) Prior Publication Data

US 2024/0200793 A1 Jun. 20, 2024

(51) Int. Cl.
*F24F 1/031* (2019.01)
*F24F 13/32* (2006.01)

(52) U.S. Cl.
CPC ..... *F24F 1/031* (2019.02); *F24F 13/32* (2013.01)

(58) Field of Classification Search
CPC ..... F24F 1/031; F24F 13/32; F24F 2221/20; F24F 1/027
See application file for complete search history.

(56) References Cited

U.S. PATENT DOCUMENTS

| | | | |
|---|---|---|---|
| 399,491 | A | 3/1889 | Del piakko |
| 1,954,017 | A | 4/1934 | Manning |
| 2,234,753 | A | 3/1941 | Frazer |
| 2,268,451 | A | 12/1941 | Hull |
| 2,294,664 | A | 9/1942 | Hubbard |
| 2,320,436 | A | 6/1943 | Hull |
| 2,436,713 | A | 2/1948 | Cody |
| 2,472,792 | A | 6/1949 | Cohler |
| 2,568,968 | A | 9/1951 | Perrin |
| 2,604,763 | A | 7/1952 | Lipman |
| 2,608,148 | A | 8/1952 | Shapiro |
| 2,708,833 | A | 5/1955 | Nigro |
| 2,814,244 | A | 11/1957 | Hord |
| 2,818,793 | A | 1/1958 | Hord |
| 2,925,026 | A | 2/1960 | Schuster |
| 2,935,284 | A | 5/1960 | Reeves |
| 3,030,873 | A | 4/1962 | Metcalfe |
| 3,134,319 | A | 5/1964 | Marsteller |
| 3,271,972 | A | 9/1966 | Knight |
| 3,318,226 | A | 5/1967 | Ulich |
| 3,476,033 | A | 11/1969 | Appel |
| 3,481,264 | A | 12/1969 | Ulich |
| 3,491,549 | A | 1/1970 | Oglesby |

(Continued)

FOREIGN PATENT DOCUMENTS

| | | | |
|---|---|---|---|
| CN | 102455025 | A | 5/2012 |
| CN | 209689075 | U | 11/2019 |

(Continued)

OTHER PUBLICATIONS

Mcnichols, Eret C., United States Patent and Trademark Office, Notice of Allowance issued in U.S. Appl. No. 17/519,061, 40 pages, dated Apr. 13, 2023.

(Continued)

*Primary Examiner* — Cassey D Bauer
(74) *Attorney, Agent, or Firm* — Gray Ice Higdon

(57) ABSTRACT

A retention bracket for a window air conditioning unit is disclosed, and more particularly, a retention bracket that pertains to securing a window air conditioning unit within a window assembly while allowing a user to open and close the window assembly in a safe and convenient manner is disclosed.

23 Claims, 6 Drawing Sheets

(56) References Cited

U.S. PATENT DOCUMENTS

| | | | |
|---|---|---|---|
| 3,552,470 | A | 1/1971 | Metcalfe |
| 3,554,476 | A | 1/1971 | Gaylor |
| 3,576,114 | A | 4/1971 | Sharp et al. |
| 3,698,208 | A | 10/1972 | Williams |
| 3,698,308 | A | 10/1972 | Navara |
| 3,861,283 | A | 1/1975 | Shaner |
| 3,911,803 | A | 10/1975 | Kong |
| 4,086,886 | A | 5/1978 | Edmaier |
| 4,152,844 | A | 5/1979 | Materniak |
| 4,203,302 | A | 5/1980 | Lapeyre |
| 4,334,461 | A | 6/1982 | Ferguson |
| 5,027,614 | A | 7/1991 | Mori |
| 5,050,831 | A | 9/1991 | Joyal |
| 5,167,131 | A | 12/1992 | Karkhanis |
| 5,253,485 | A | 10/1993 | Kennedy |
| 5,290,343 | A | 3/1994 | Morita |
| 5,365,992 | A | 11/1994 | Swain |
| 5,582,025 | A | 12/1996 | Dubin et al. |
| 5,823,289 | A | 10/1998 | Csomos |
| 5,979,172 | A | 11/1999 | Teller |
| 5,979,533 | A | 11/1999 | Dupuie |
| 6,173,930 | B1 | 1/2001 | Arbucci |
| 6,257,013 | B1 | 7/2001 | Murray |
| 6,568,201 | B1 | 5/2003 | Cur et al. |
| 6,767,278 | B1 | 7/2004 | Peterson |
| 7,121,105 | B1 | 10/2006 | Rais |
| 7,296,424 | B2 | 11/2007 | Thompson |
| 7,332,019 | B2 | 2/2008 | Bias |
| 7,350,759 | B1 | 4/2008 | Gray |
| 7,753,334 | B2 | 7/2010 | Schreiber |
| 7,854,141 | B1 | 12/2010 | Breen |
| 7,975,441 | B2 | 7/2011 | McCarriston |
| 8,091,844 | B1 | 1/2012 | Bragg |
| 8,104,240 | B2 | 1/2012 | McCarriston |
| 8,578,728 | B2 | 11/2013 | Cho |
| 8,584,998 | B1 | 11/2013 | Peterson |
| 9,163,854 | B2 | 10/2015 | Arbucci |
| 9,303,895 | B1 | 4/2016 | Grant |
| 9,447,916 | B2 | 9/2016 | Darby |
| D782,289 | S | 3/2017 | Darby |
| 9,605,870 | B2 | 3/2017 | Darby |
| 9,890,961 | B1 | 2/2018 | Sheldon |
| 9,909,712 | B1 | 3/2018 | Darby |
| 9,938,044 | B2 | 4/2018 | Gamboa |
| 9,982,909 | B1 | 5/2018 | Perez et al. |
| 10,203,130 | B2 | 2/2019 | Gardikis, Sr. |
| 10,203,180 | B2 | 2/2019 | Miller |
| 10,295,221 | B2 | 5/2019 | Zhang |
| 10,359,212 | B2 | 7/2019 | Darby |
| 10,401,043 | B2 | 9/2019 | Li |
| 10,520,206 | B2 | 12/2019 | Xu |
| 10,739,018 | B2 | 8/2020 | Baumann et al. |
| 10,900,689 | B2 | 1/2021 | Weiner |
| 11,168,920 | B1 | 11/2021 | Leezer et al. |
| 11,397,023 | B2 | 7/2022 | Xing et al. |
| 11,415,329 | B2 | 8/2022 | Liu et al. |
| 11,441,791 | B2 | 9/2022 | Lei et al. |
| 11,441,792 | B2 | 9/2022 | Liang et al. |
| 2001/0032545 | A1 | 10/2001 | Goto |
| 2003/0097854 | A1 | 5/2003 | Cur |
| 2003/0110789 | A1 | 6/2003 | Cur |
| 2005/0028545 | A1 | 2/2005 | Hebert |
| 2006/0021359 | A1 | 2/2006 | Hur |
| 2007/0023592 | A1 | 2/2007 | Makoso |
| 2007/0068185 | A1 | 3/2007 | Thompson |
| 2007/0107329 | A1 | 5/2007 | Ferrara |
| 2007/0137237 | A1 | 6/2007 | Rais |
| 2008/0053309 | A1 | 3/2008 | Woodruff |
| 2008/0104989 | A1 | 5/2008 | Movshovitz |
| 2010/0077924 | A1 | 4/2010 | Zhao |
| 2010/0197214 | A1 | 8/2010 | Geremia, Sr. |
| 2010/0229585 | A1 | 9/2010 | Bradford |
| 2010/0326103 | A1 | 12/2010 | Stamm |
| 2011/0040412 | A1 | 2/2011 | Wiese |
| 2012/0137499 | A1 | 6/2012 | Agnihotri |
| 2012/0274188 | A1 | 11/2012 | Shiborino |
| 2013/0104581 | A1 | 5/2013 | Consoli |
| 2013/0153744 | A1 | 6/2013 | Jin |
| 2013/0327509 | A1 | 12/2013 | Michitsuji |
| 2014/0020421 | A1 | 1/2014 | Gallo |
| 2014/0076506 | A1 | 3/2014 | Olivas |
| 2014/0090334 | A1 | 4/2014 | Darby |
| 2014/0311063 | A1 | 10/2014 | McIntyre |
| 2015/0034784 | A1 | 2/2015 | Darby |
| 2015/0097096 | A1 | 4/2015 | Arbucci |
| 2015/0211802 | A1 | 7/2015 | Yokozeki |
| 2016/0033166 | A1 | 2/2016 | Hebert |
| 2016/0097547 | A1 | 4/2016 | Selg |
| 2017/0191763 | A1 | 7/2017 | Xu |
| 2017/0284683 | A1 | 10/2017 | Gallo |
| 2017/0297768 | A1 | 10/2017 | Gamboa |
| 2017/0328596 | A1 | 11/2017 | Darby |
| 2018/0023842 | A1 | 1/2018 | Gardikis, Sr. |
| 2018/0149387 | A1 | 5/2018 | Darby |
| 2018/0180305 | A1 | 6/2018 | Zhang |
| 2019/0056143 | A1 | 2/2019 | Zhang |
| 2019/0063760 | A1 | 2/2019 | Li |
| 2019/0212032 | A1 | 7/2019 | Martinez Galvan |
| 2020/0124296 | A1 | 4/2020 | Baumann |
| 2020/0248911 | A1 | 8/2020 | Lei |
| 2020/0333021 | A1 | 10/2020 | Martinez Galvan |
| 2020/0363075 | A1 | 11/2020 | Bradford |
| 2021/0010688 | A1 | 1/2021 | Biasotti et al. |
| 2021/0078118 | A1 | 3/2021 | Li et al. |
| 2021/0088251 | A1 | 3/2021 | Galvan et al. |
| 2021/0164667 | A1 | 6/2021 | Yu et al. |
| 2021/0180828 | A1 | 6/2021 | Xing |
| 2021/0207819 | A1 | 7/2021 | Zhang et al. |
| 2021/0222891 | A1 | 7/2021 | Rao et al. |
| 2021/0325054 | A1 | 10/2021 | Zhao |
| 2021/0341175 | A1 | 11/2021 | Leezer |
| 2021/0355750 | A1 | 11/2021 | Liang et al. |
| 2021/0356145 | A1 | 11/2021 | Lei et al. |
| 2021/0356146 | A1 | 11/2021 | Zhang |
| 2021/0404749 | A1 | 12/2021 | Wexler |
| 2022/0057109 | A1 | 2/2022 | Leezer |
| 2023/0026722 | A1 | 1/2023 | Yu |
| 2023/0194123 | A1 | 6/2023 | Palomäki |
| 2023/0375222 | A1 | 11/2023 | Leezer |
| 2024/0200794 | A1 | 6/2024 | Derossett |

FOREIGN PATENT DOCUMENTS

| | | | |
|---|---|---|---|
| WO | 2020038239 | A1 | 2/2020 |
| WO | 2020228408 | A1 | 11/2020 |

OTHER PUBLICATIONS

Mcnichols, Eret C., United States Patent and Trademark Office, Notice of Allowance issued in U.S. Appl. No. 18/230,562, 79 pages, dated Mar. 13, 2024.

Climaloc; "Top & Sides Door Seal Spring-Loaded Kit"; https://climalocsolutions.com/product/top-sides-door-sealspring-loaded-kit-2/; Climaloc; dated Nov. 2, 2022.

Related Applications Transmittal dated Jan. 5, 2023.

Mcnichols, Eret C., United States Patent and Trademark Office, Non-Final Office Action issued in U.S. Appl. No. 17/519,061, 18 pages, dated Sep. 30, 2022.

Trpisovsky, Joseph F., United States Patent and Trademark Office, Notice of Allowance issued in U.S. Appl. No. 18/068,386, 52 pages, dated Nov. 4, 2024.

Home Depot; "How to Install a Window Air Conditioner"; retrieved from https://www.homedepot.com/c/ah/how-to-install-a-window-air-conditioner/9ba683603be9fa5395fab90e6808e44; retrieved on Nov. 2, 2022.

WINDOW AIR CONDITIONING UNIT RETENTION BRACKET

BACKGROUND

Window installed air conditioning units are common home appliances nowadays. A traditional window air conditioning unit is typically placed on a mounting bracket on a horizontal windowsill when a window sash is open. The window sash is then partially closed to rest on the top surface of the unit outer casing, and the unit is typically attached rigidly to the window sash frame via a flange or a shroud to be affixed in the window opening. Such a "window-defined" enclosure for the traditional window air conditioning unit requires the window sash to remain in place and in contact with the top of the air conditioning unit at all times. Consequently, the window sash cannot be opened during times of the year when it is desired to get fresh air from outside, or whenever a user would prefer to open the window instead of running the air conditioning unit. Also, the window sash cannot be closed beyond the top of the window air conditioning unit, which means the noise generated by the window air conditioning unit outdoor component including the compressor and the fan is always a problem for consumers.

Embodiments herein disclose a new window air conditioning unit design that allows consumers to open or close the window after installation. Such embodiments also include a retention device that is easy to install by consumers, eliminates the risk of the unit falling, and also permits a window sash to be raised and lowered freely by consumers.

SUMMARY

The present apparatus relates to a retention bracket for insertion across a window assembly, and more particularly to a retention device for a window air conditioning unit design having a window slot between an indoor portion and an outdoor portion, into which a window sash may be lowered. The retention bracket may include one or more brackets that can engage the window air conditioning unit and/or window assembly, thus preventing the unit from falling into or out of the window.

The present disclosure provides an improved retention bracket with major advantages including, but is not limited to: ease of installation and adjustability to fit into various sized window openings; maintaining the appearance of the window air conditioning unit; avoiding the possible damages to the structure of the window sash; and allowing for the window to be opened or closed after the window air conditioning unit is installed. The apparatus may also work with other similar industrial designs of window air conditioning units, achieving similar advantages as outlined above.

In some embodiments, a retention bracket for securing a window air conditioning unit in a window assembly, the window assembly having at least one vertically operable window sash, a horizontal windowsill, and two vertical side window tracks, the window air conditioning unit having a window slot therewithin separating an indoor portion from an outdoor portion, wherein the window slot is for receiving at least one vertically operable window sash, the retention bracket may include at least one first bracket having a first end and a second end, wherein the first end and the second end of at least one first bracket are configured to be received within the vertical side window track to provide support to the window air conditioning unit, wherein at least one first bracket is positioned between the window slot of the window air conditioning unit and the windowsill. In various embodiments, at least one second bracket may include a first end and a second end, wherein at least one second bracket may be positioned in the window slot of the window air conditioning unit, and wherein the first end and the second end of at least one second bracket may be affixed to at least one first bracket.

In addition, in some embodiments, the first end and the second end of at least one second bracket may be affixed to at least one first bracket between the window track and the window slot. In various embodiments, the first end and the second end of at least one second bracket may be affixed to at least one first bracket via one or more fasteners. In some embodiments, the one or more fasteners may engage the windowsill of the window air conditioning unit. In various embodiments, the first end and the second end of at least one second bracket may be affixed to the window track via one or more fasteners. In some embodiments, the first end and the second end of at least one first bracket may include a projection extending for a length in the window track of the window air conditioning unit. In various embodiments, the projection may extend upwardly within the window track of the window air conditioning unit. In some embodiments, at least one first bracket may be adjustable in length. In some embodiments, at least one first bracket may include a base having a track guide slidably receiving at least one of the first end and/or the second end of at least one first bracket. In various embodiments, the track guide may slidably receive both of the first end and the second end of at least one first bracket. In various embodiments, the retention bracket may be in combination with a window air condition unit.

In some embodiments, a method of securing a window air conditioning unit in a window assembly, the window assembly may have at least one vertically operable window sash, a horizontal windowsill, and two vertical side window tracks, the window air conditioning unit having a window slot therewithin separating an indoor portion from an outdoor portion, wherein the window slot is for receiving at least one vertically operable window sash, the method may include providing a retention bracket having a first bracket and a second bracket, wherein each one of the first bracket and the second bracket may include a first end and a second end. In various embodiments, the method may include raising the window sash to a first position and installing the first bracket. In some embodiments, the method may include inserting the first end and the second end of the first bracket into the vertical side window track. In various embodiments, the method may include positioning the window air condition unit onto the first bracket. In some embodiments, the method may include providing the second bracket in the window slot of the window air conditioning unit. In some embodiments, the method may include affixing at least one of the first end and/or the second end of the second bracket to the first bracket. In various embodiments, the method may include lowering the window sash to a second position.

In addition, in some embodiments, the first position may be when the window sash is outside the window slot, and the second position is when the window sash is inside the window slot. In various embodiments, the method may include adjusting a length of the first bracket to engage the first end and the second end of the first bracket to the vertical side window track. In some embodiments, the first bracket may include a base having a track guide slidably receiving at least one of the first end and/or the second end of the first bracket to adjust the length of the first bracket. In various embodiments, the method may include affixing the first end and the second end of the first bracket to the vertical side window track. In some embodiments, the method may include affixing the first end and the second end of the second bracket to the first bracket. In various embodiments, the first end and the second end of the second bracket may be affixed to the first bracket between the vertical side window track and the window slot. In some embodiments, the method may include affixing the first end and the second end of the second bracket to the windowsill. In various embodiments, the method may include installing a main mounting bracket and placing the window air conditioning unit onto the main mounting bracket.

In some embodiments, a retention bracket for securing a window air conditioning unit in a window assembly, the window assembly having at least one vertically operable window sash, a horizontal windowsill, and two vertical side window tracks, the window air conditioning unit having a window slot therewithin separating an indoor portion from an outdoor portion, wherein the window slot is for receiving at least one vertically operable window sash, the retention bracket may include at least one first bracket having a first end and a second end, wherein the first end and the second end of at least one first bracket are configured to be received within the vertical side window track to provide support to the window air conditioning unit, wherein at least one first bracket may be positioned between the window slot of the window air conditioning unit and the windowsill. In various embodiments, at least one second bracket may include a first end and a second end, wherein at least one second bracket may be positioned in the window slot of the window air conditioning unit, and wherein the first end and the second end of at least one second bracket may be affixed to at least one first bracket. In some embodiments, the window air conditioning unit may allow the window assembly to be adjustable between a first position and a second position.

In addition, in some embodiments, the retention bracket may include a main mounting bracket. In various embodiments, the first position may be when the window sash is outside the window slot and the second position is when the window sash is inside the window slot.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present disclosure is provided in the following written description of various embodiments of the disclosure, illustrated in the accompanying drawings, and defined in the appended claims.

DETAILED DESCRIPTION

Figure 1:
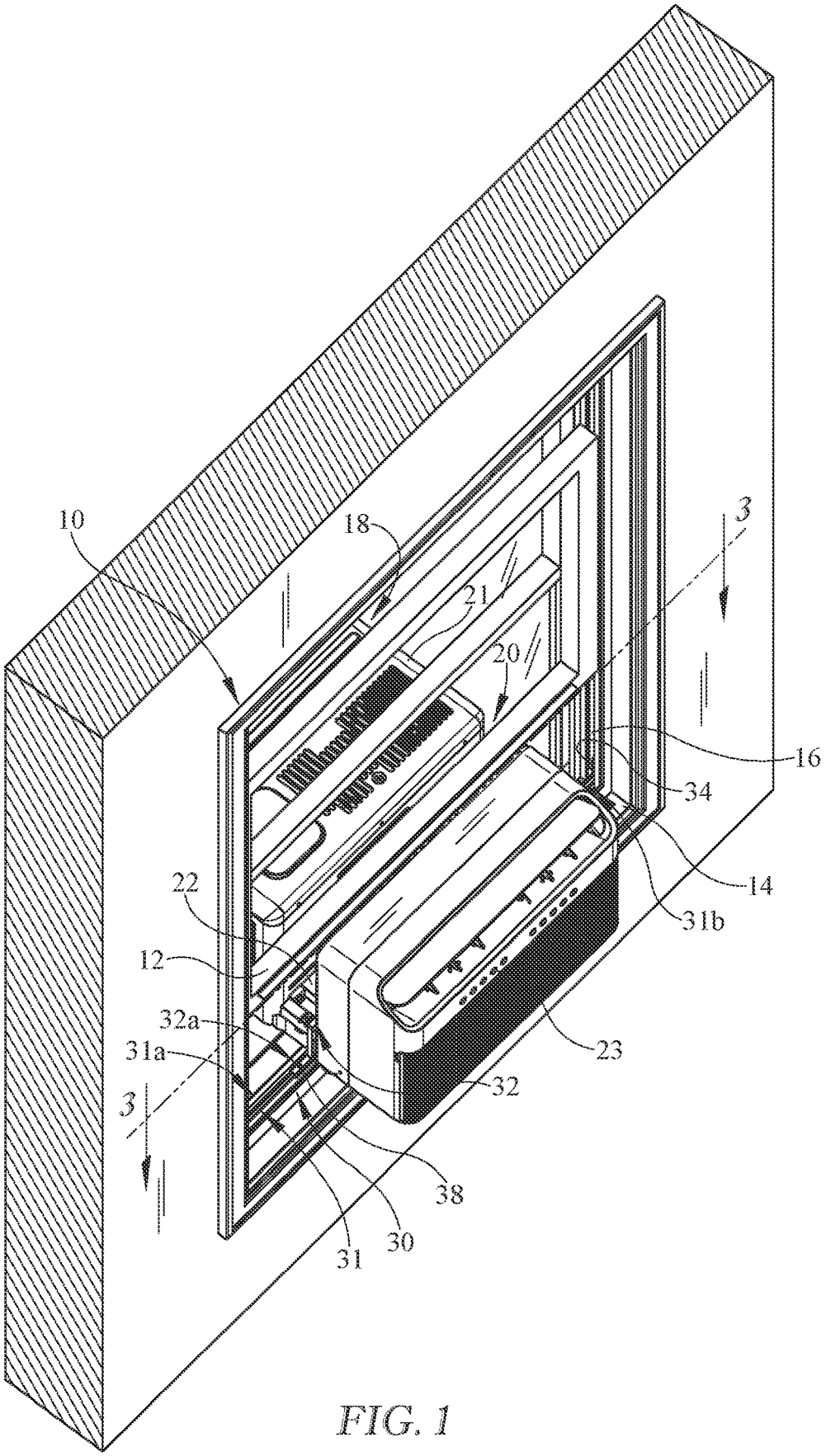
FIG. 1 is a perspective view of a window air conditioning unit installed using a retention bracket in accordance with various embodiments, viewed from the inside of a room with the window open.

It is to be understood that a window air conditioning unit retention bracket is not limited in its application to the details of construction and the arrangement of components set forth in the following description or illustrated in the exemplary drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to direct physical or mechanical connections or couplings.

Turning now to the drawings and in particular FIGS. 1-6, wherein like numbers denote like parts throughout the several views, one or more retention brackets 30 in accordance with various embodiments may be used for a window air conditioning unit 18 mounted in a window assembly 10. The type, size, and shape of the window air conditioning unit 18 may be varied while remaining within the scope of the present disclosure. In some embodiments, as shown in the FIGS. 1-3, the window air conditioning unit 18 may be U-shaped with a window slot 20 between an outdoor portion 21, which is disposed outside of a room, and an indoor portion 23, which is disposed inside of the room. The window slot 20 may allow the window assembly 10 to be closed into the overall casing structure of the window air conditioning unit 18. The overall casing structure may be the outer casing perimeter adapted to enclose all the components of the window air conditioning unit 18, including but not limited to, the evaporator coil, the condenser coil, the compressor, the fan, the motor, etc. In the embodiments shown, the casing may include two main components; a casing for the indoor portion 23 and a casing for the outdoor portion 21.

Figure 2:
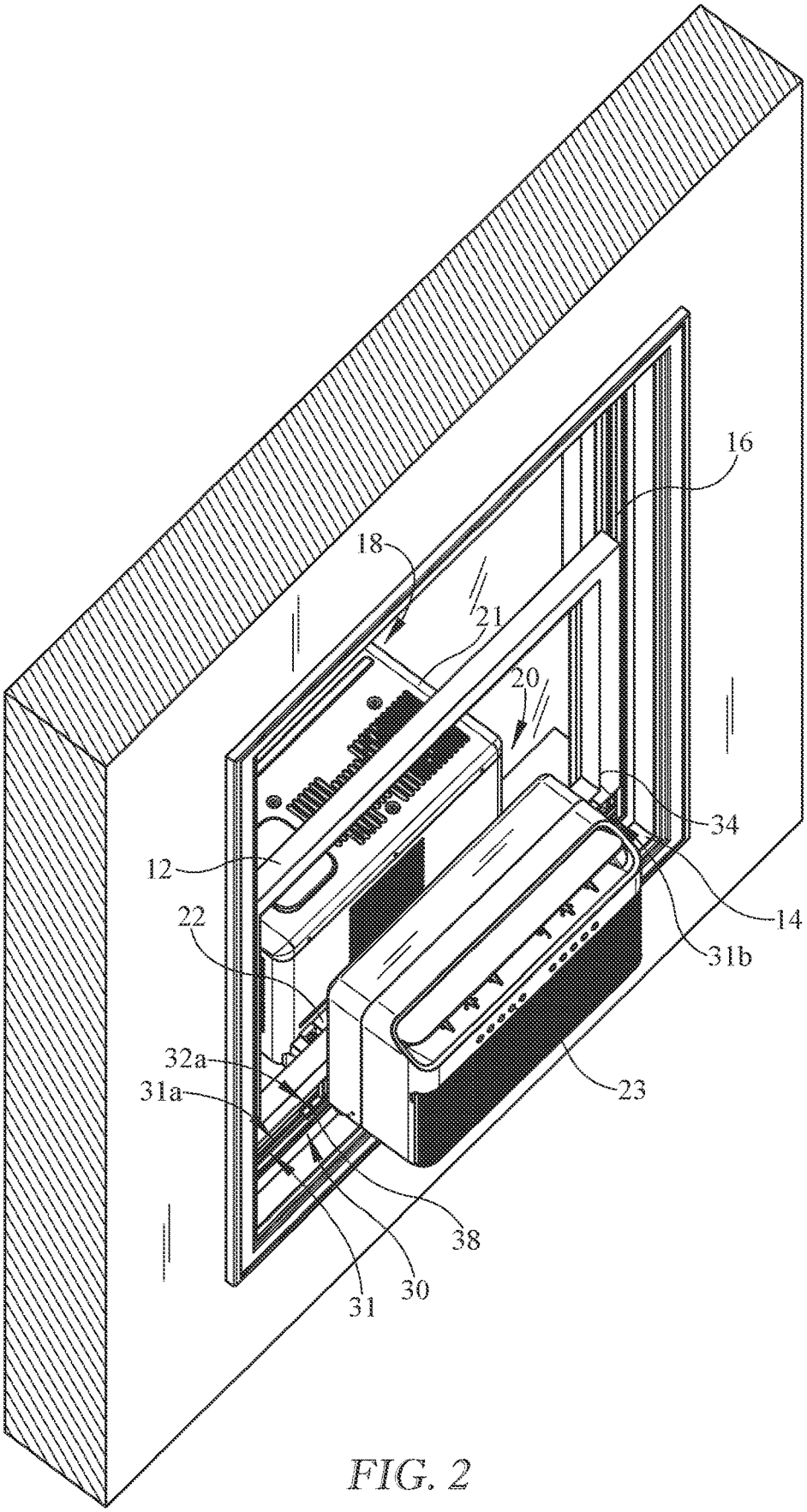
FIG. 2 is a perspective view of the apparatus of FIG. 1, illustrating when the window is closed.
Figure 3:
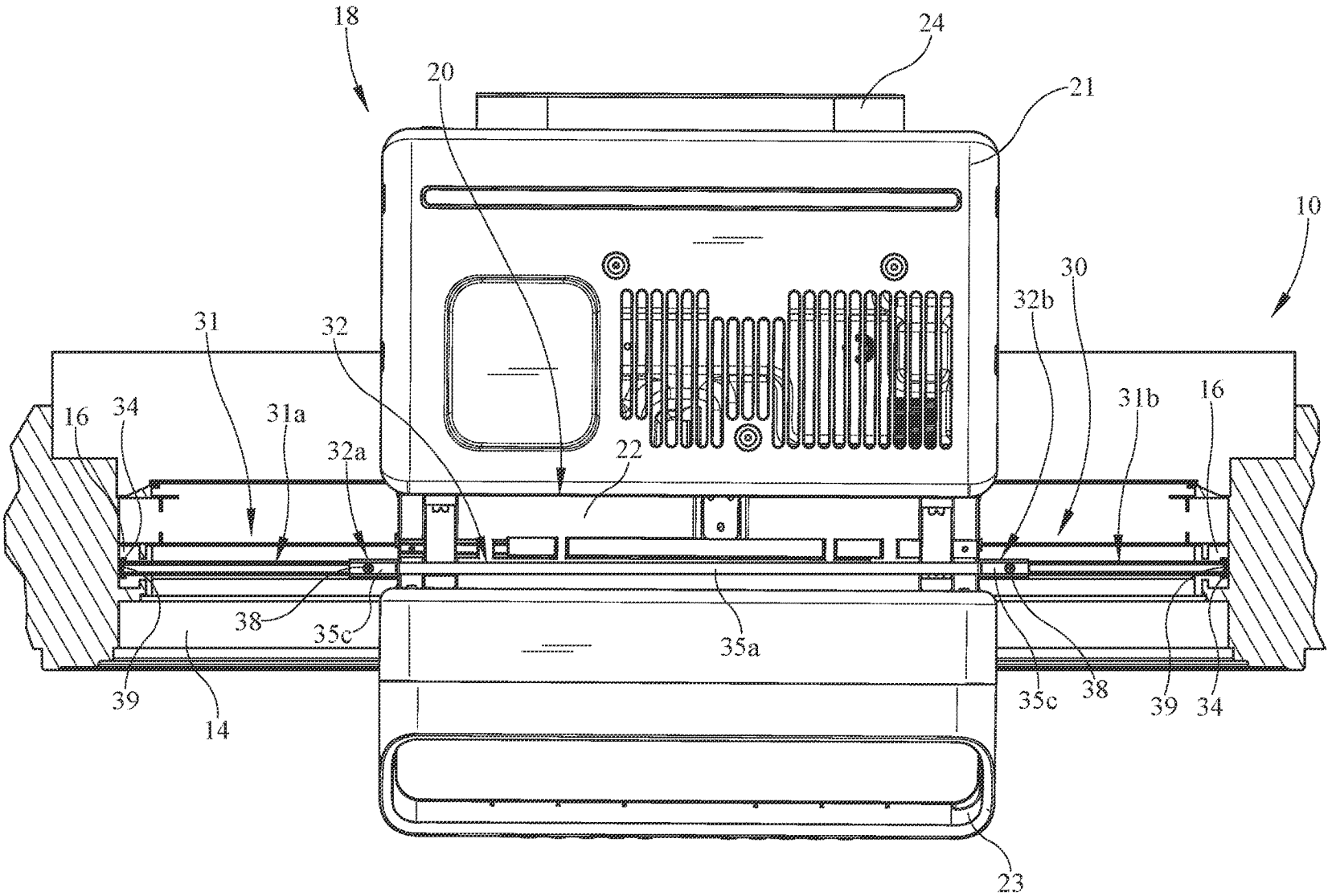
FIG. 3 is a top sectional view taken along line 3-3 of FIG. 1.

In some embodiments, as best shown in FIGS. 1 and 2, the window assembly 10 may include a vertically operable window sash 12, a horizontal windowsill 14, and a pair of vertical side window tracks 16 for slidably receiving the vertical side faces of the window sash 12. Thus, the window sash 12 may be vertically slid up and down by a user. Basically, any size window is acceptable, but ideally, the window assembly 10 may be a standard double hung window with a width of approximately 22 to 36 inches and a height of approximately 13.5 inches.

In some embodiments, the window air conditioning unit 18 may be installed upon the horizontal windowsill 14 of the window assembly 10, and a main mounting bracket 24, if used, may be installed to help support the window air conditioning unit 18 within the window assembly 10. In some embodiments if a main mounting bracket is used, the retention bracket 30 may be engaged to or disengaged from the main mounting bracket 24, or portion thereof. The main mounting bracket 24 can be of the type disclosed in U.S. Pat. No. 11,168,920, issued Nov. 9, 2021, the entire contents of which is herein incorporated by reference in its entirety.

In some embodiments, there may be also at least one sealing member to close off the remaining gap between the lowered window sash 12 and the horizontal windowsill 14 after installation. The sealing member, if used, may be, for example, in an elongated rectangular configuration and made from material suitable for sealing window gaps, for example, foam. In some embodiments, the sealing member may be installed on both sides of the window air conditioning unit 18 or window slot 20.

Figure 4:
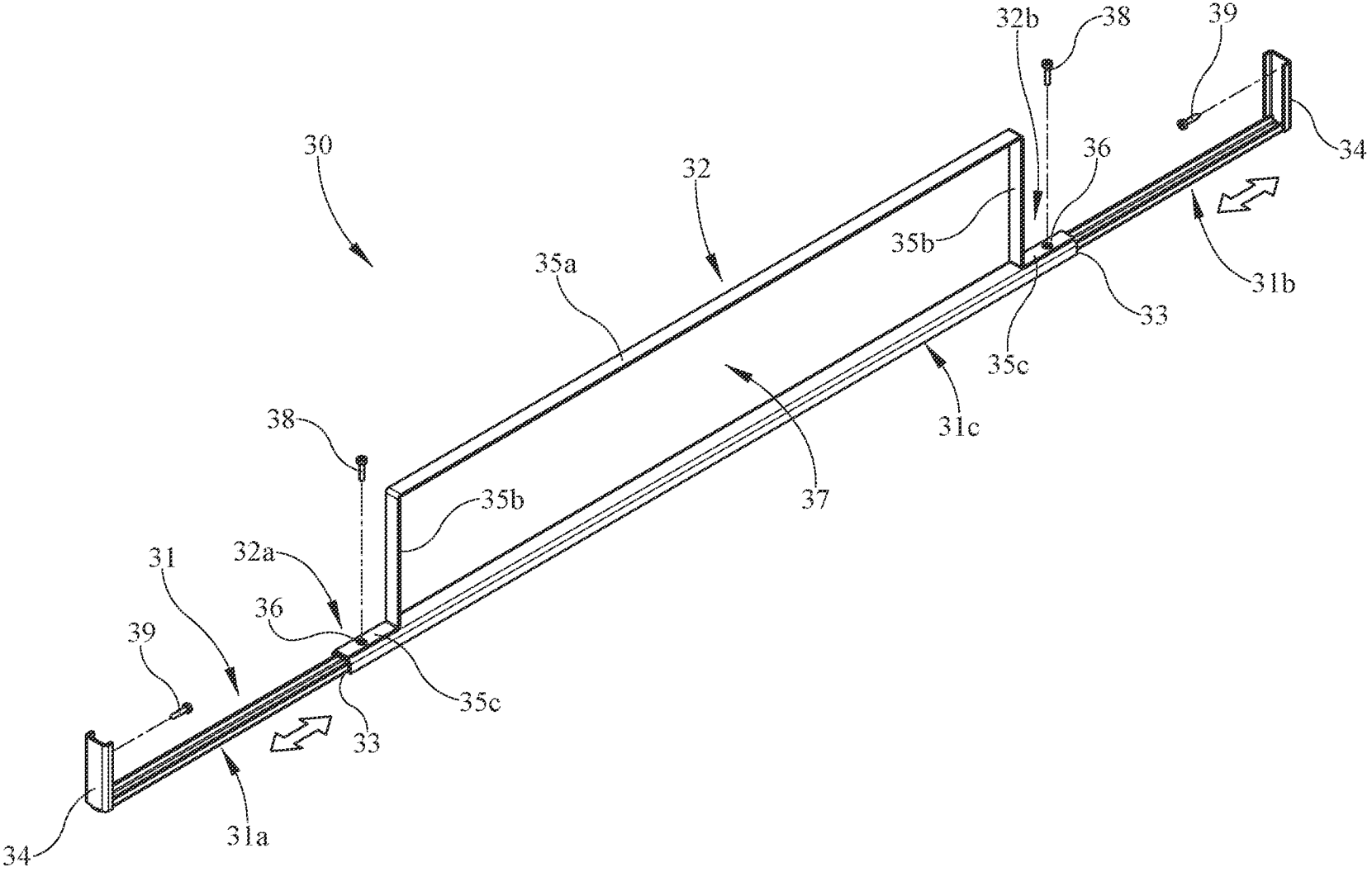
FIG. 4 is a perspective view of one embodiment of the retention bracket in accordance of FIG. 1.
Figure 5:
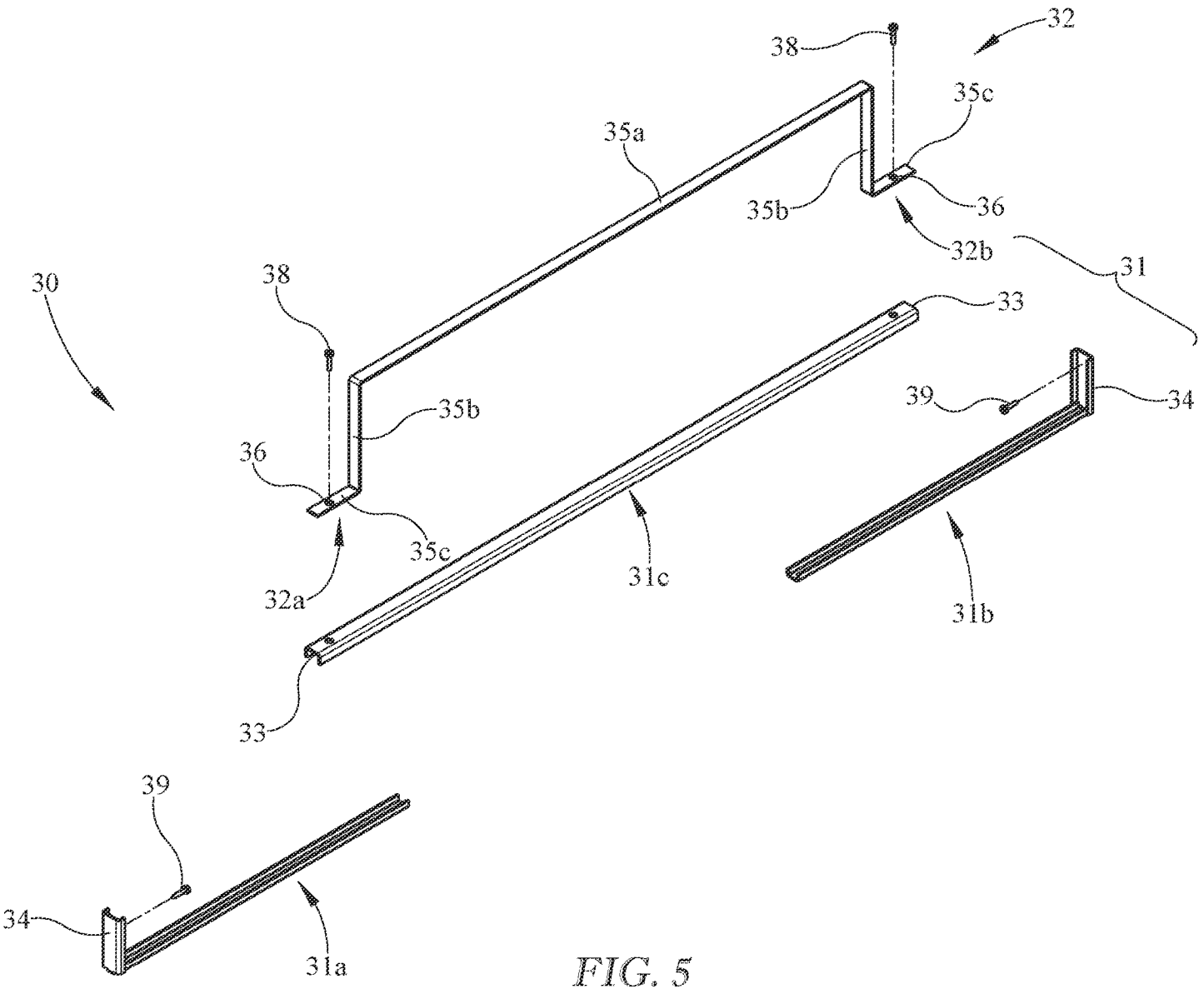
FIG. 5 is an exploded view of the retention bracket of FIG. 4
Figure 6:
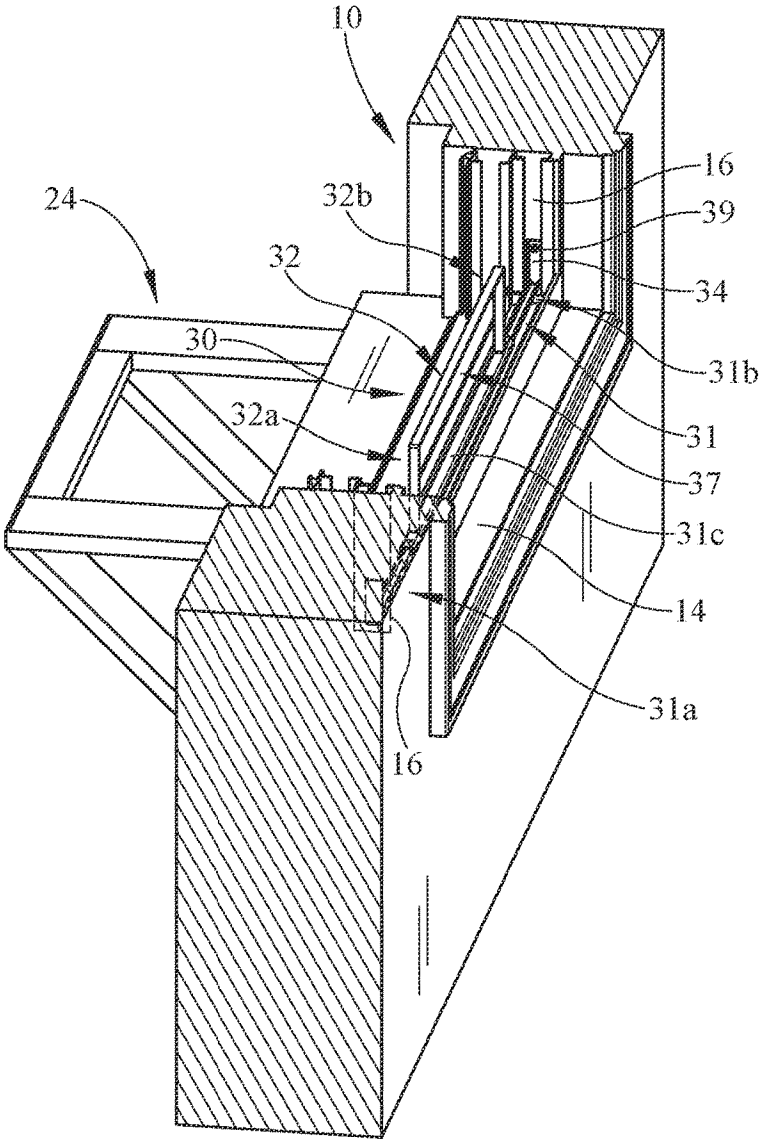
FIG. 6 is a perspective view of the retention bracket of FIG. 1 with the window air condition unit removed.

As mentioned above, the retention bracket 30 may be used to minimize the risk of the window air conditioning unit 18 falling or tipping from the window assembly 10 during installation, after installation, and/or removal due to external forces acting on the unit. FIG. 4 illustrates the retention bracket 30 comprising one or more brackets (e.g. 31, 32). As shown in the one embodiment, the retention bracket 30 may include at least one first bracket 31 and at least one second bracket 32 in accordance with various embodiments. The one or more brackets (e.g. second bracket 32 and the first bracket 31) may surround/engage (e.g. 360 degrees, less than 360 degrees, or portions of the circumference thereof) the window slot (e.g. bottom wall 22, one of more side walls, outer periphery, or portions thereof) and/or the outer periphery/portion(s) of the window air conditioning unit connecting the indoor portion 23 to the outdoor portion 21.

In some embodiments, the window air conditioning unit 18, retention bracket 30, and/or first bracket 31 may include a base 31*c* and/or one or more opposing ends 31*a*, 31*b* (e.g. first, second). The first bracket 31 may be fabricated of, but is not limited to, an essentially rigid material, for example, an extruded metal such as steel or aluminum. The first bracket 31 may be a single piece construction or may include a fixed length in some embodiments. The fixed length first bracket (e.g. opposing first and second ends) may engage the window assembly 10 of a predetermined length (e.g. side window tracks). For example, one or more first brackets of a variety of fixed lengths may be selected by the user for a window assembly application. The first bracket 31 may have parts or pieces that are movable or extendable so as to adjust length. A variable length first bracket may be created by two or more portions/members (e.g. base, end(s)) moveable relative to each other to adjust to different window assembly widths. In the one embodiment shown in the Figures, a base 31*c* may include a track guide 33 (e.g. portions thereof, opposing ends) for receiving (e.g. slidably) the one or more ends (e.g. first end 31*a*, second end 31*b*, remaining portions of the first bracket) of the first bracket 31. The one or more ends 31*a*, 31*b* of the first bracket 31 may move relative to each other and/or to the base 31*c* to adjust a length of the first bracket to engage one or more portions of the window assembly 10 (e.g. opposing vertical side window tracks, varying widths). In some embodiments, only one end may be slidable or move relative to the base/opposing end. In the one embodiment shown, both the first end 31*a* and the second end 31*b* may work with the base 31*c*, such that the two ends 31*a* and 31*b* may be telescoped or slidably received within the track guide 33 of the base 31*c* to allow a user to vary/adjust the length in order to fit into or to adjust to the window assembly 10 of different widths. The first bracket 31, or portions thereof, may be extended until one or more ends is fully located into the vertical side window tracks 16 to provide sufficient support. In some embodiments, the first bracket 31, or portions thereof, may be an elongated rectangular shape. In some embodiments, as shown in FIG. 4, the first bracket 31, or portions thereof, may also include one or more projections 34 and/or ends 31*a*, 31*b* engaging one or more portions of the window assembly (e.g. one or more window tracks). The first end 31*a* and/or second end 31*b* may be configured to be received within the side window track 16. The first end 31*a* and/or second end 31*b* may include the one or more projections 34. The projections 34 may extend for a length (e.g. vertically) within the window track 16. As shown in the one embodiment, the projection 34 extends upwardly within the window track 16 away from each opposing ends of the first bracket. The ends 31*a*, 31*b* and/or projections 34, if used, may reduce rotation of the retention bracket (e.g. first bracket, second bracket) and/or unit 18 by being constrained to at least one position within the window track. In some embodiments, only one bracket may be used. The retention bracket 30 may have parts or pieces that are movable or extendable so as to adjust length.

When installed, the first bracket 31 may be positioned between the window air condition unit 18 and the window assembly 10. As shown in the one embodiment, the first bracket 31, or portions thereof, are positioned between window slot 20 and the windowsill 14. For example, the base 31*c*, first end 31*a*, and/or second end 31*b* may engage or be positioned beneath the window slot 20, or portions thereof, (e.g. bottom wall 22).

In some implementations, the window air conditioning unit 18, retention bracket 30, and/or first bracket 31 may include one or more second brackets 32. The second bracket 32 may include a first end 32*a* and a second end 32*b*. The second bracket 32 may be substantially U-shaped. In some embodiments, the second bracket 32 may be an inverted U-shaped and affixed to the first bracket (e.g. base, first end, second end). The second bracket may have a top member 35*a*, opposing depending members 35*b* depending from the ends of the top member 35*a*, and outwardly projecting members 35*c* extending from the ends of the depending members. The first end 32*a* may be similar to the second end 32*b*, but may be different in some embodiments. The second bracket 32 may be aligned with or positioned along the length or direction of the first bracket 31. The first end 32*a* and the second end 32*b* or one or more portions of the second bracket 32 (e.g. projecting members 35*c*) may include one or more apertures 36, if used, for receiving one or more fasteners 38, if used. As shown in the one embodiment, the second bracket 32 and the first bracket 31 may define a through opening 37 receiving the window slot 20 (e.g. bottom wall), or portions thereof. Although the second bracket 32 is shown as fixed in length, the second bracket or portions thereof may be adjustable in length. The second bracket 32 may be fabricated of, but is not limited to, an essentially rigid material, for example, an extruded metal such as steel or aluminum. In some embodiments, the second bracket 32, or portions thereof, may be an elongated rectangular shape. The second bracket may be one or more members.

In order to affix the second bracket 32 to the first bracket 31 and/or retention bracket 30, or portions thereof, to the window assembly 10, various securement arrangements/mechanisms (e.g. apertures, fasteners) may be provided. In some embodiments, the retention bracket 30, or portions thereof, may include one or more drilled or punched holes or slots/apertures 36 for anchoring one or more fasteners 38, 39 through to affix the first bracket with the second bracket and/or the retention bracket 30, or portions thereof, to one or more portions of the window assembly 10. Apertures 36 may not be used in some embodiments. For example, a fastener 38, 39 may be driven through one or more portions of the retention bracket, without one or more apertures, to affix portion of the brackets therebetween and/or to the window assembly. In the one embodiment shown, one or more fasteners 38 (e.g. first) may be used to affix the second bracket 32 to or with the first bracket 31. As shown in the one embodiment, the fastener 38 may extend through the aperture 36 of the second bracket 32 and engage/affix to the first bracket, or portions thereof. The fastener 38 may engage or affix to the base 31*c*, one or more ends 31*a* and/or 31*b* (e.g. apertures, if used), and/or one or more portions of the window assembly (e.g. windowsill, apertures, if used). In some embodiments, one or more fasteners 38, 39 may fix the length of the first/second bracket. For example, the fastener 38 may engage the one or more moveable portions (e.g. first end 31*a*, second end 31*b*, and/or base 31*c*). One or more second fasteners 39 may engage the retention bracket 30, or portions thereof, to the window assembly 10 alone or in addition to first fasteners 38 engaging the first and second bracket therebetween. Second fastener(s) 39 may affix the first end 31*a*/32*a*, second end 31*b*/32*b*, first bracket, second bracket, and/or base to one or more portions of the window assembly 10. As shown in the one embodiment, the second fasteners 39 may affix the first and/or second ends 31*a*, 31*b* (e.g. first bracket, one or more projections 34) to the window track 16. Although not shown, the first/second ends 31*a*, 31*b* and/or projection(s) 34 may include one or more apertures 36 to receive the one or more fasteners 39. The fasteners and/or apertures may be a variety of quantities, shapes, sizes, constructions, and positions within the retention bracket and still be within the scope of the invention. The fastener 38/39 may be a bolt or a screw of different sizes and types (e.g., slot, cross, hex, Philips, etc.). Various other fasteners are possible, including, for example, ball detents, movable pins, spring-loaded pins, posts, tongue-and-groove, and the like. In some embodiments, the fastener (e.g. bolt or the screw) may be factory pre-installed. It should be understood that the fastener 38/39 may be fastened tight to prevent inadvertent loosening of the retention bracket 30, or portions thereof.

With the retention bracket 30 installed, the window air conditioning unit 18 may bear its weight on the window assembly 10, or portions thereof, (e.g. against the window track, windowsill, sash, etc.) and/or on the main mounting bracket 24, if used. The retention bracket 30 thereof may provide a resistive support to the torque of the window air conditioning unit 18 biased thereagainst by the one or more brackets 31, 32 (e.g. the first end 31*a* and/or the second end 31*b* positioned in the two vertical side window tracks 16) affixed to or engaging one or more portions of the window assembly 10. With such a supportive arrangement, the window air conditioning unit 18 may still remain resting safely within the window assembly 10 when the window sash 12 is lowered to "close the window". In this way, the noise level caused by the outdoor portion 21 including the compressor and the fan may be reduced with the window sash 12 working as a sound barrier between the outdoor portion 21 and the inside of the room. Also, the window sash 12 may be raised to "open the window" to allow fresh air into the room. The burden supporting of the window air conditioning unit 18 may be transferred to the main mounting bracket 24, if used, and the aggregate structure of the window assembly 10 through the window track 16 instead of supporting and maintaining the load only by the window sash 12, such an arrangement may also reduce the distortive "bowing" or "bruising" of the window sash 12. FIG. 1 shows the window assembly 10 in a first position (the window sash 12 is raised outside the window slot 20 and above the overall casing structure of the window air conditioning unit 18), and FIG. 2 shows the window assembly 10 in a second position (the window sash 12 is lowered inside the window slot 20 and rests on the retention bracket (e.g. second bracket, top surface) below the top of the overall casing structure).

Having described the structural components of the retention bracket 30, a method of installation will now be described. In some implementations, the method may include providing the retention bracket 30, first bracket 31, and/or the second bracket 32. The method may include raising the window sash 12 to a first position to install the main mounting bracket 24, if used, and/or retention bracket 30, or portions thereof, within the window assembly 10. The user may install the first bracket 31 and/or window air conditioning unit 18 into the window assembly. The first bracket 31 may be positioned in or against the windowsill 14 (e.g. horizontally). If the first bracket 31 and/or second bracket is not integral with the window air conditioning unit 18, the window air conditioning unit or window slot 20 may be positioned onto or placed on the top of the first bracket 31 within the window assembly 10. A portion of the retention bracket or first bracket may be positioned between the window slot 20 and the windowsill 14. The first end 31*a* (e.g. projections 34) and/or second end 31*b* may be inserted into the opposing vertical side window track 16, respectively. The second bracket 32 may be provided or positioned in the window slot 20 of the window air conditioning unit 18 before or after the window air conditioning unit 18 is positioned in the window assembly. The second bracket 32 may be affixed to the first bracket 31 and/or portions of the window assembly (e.g. window sash, one or more tracks). In some embodiments, at least one of the first end 32*a* and/or second end 32*b* of the second bracket 32 may be affixed to the first bracket (e.g. base 31*c*, first end 31*a*, second end 31*b*) via one or more fasteners 38 (e.g. first). The ends (e.g. first end 32*a*, second end 32*b*) of the second bracket 32 may be affixed to the first bracket 31 between the side window track 16 and the window slot 20 (e.g. bottom wall 22), opposing ends of the base 31*c*, and/or adjacent ends of the second bracket 32. In some embodiments, the fasteners 38 (e.g. first) may affix the second bracket 32 (e.g. first end, second end) and/or first bracket 31 to the window assembly 10 (e.g. windowsill). In various embodiments, one or more fasteners 39 (e.g. second) may engage the first bracket 31 to the window assembly. The fasteners 39, if used, may affix at least one of the first end 31*a* and/or second end 31*b* to the window track 16, respectively. The user may adjust the length of the first bracket 31 to engage the window assembly 10 or window track 16. The sliding/telescoping engagement (e.g. track guide, base) may adjust the length of one or more ends (e.g. 31*a*, 31*b*) of the first bracket 31. The base 31*c* may include the track guide(s) 33 to slidably receive the first end 31*a* and/or second end 31*b* to adjust the length. With the window sash 12 still open, the sealing member, if used, may be installed to close off the remaining gap between the lowered window sash 12 and the horizontal windowsill 14 and/or bracket 30.

Upon the completion of the installation, the window air conditioning unit 18 is now secured within the window assembly 10 via the one or more retention brackets 30. With the retention bracket 30 properly installed, the window assembly 10 or sash 12 may be adjusted between the first position and the second position without disturbing the window air conditioning unit 18.

In some embodiments, the first position of the window assembly 10 may be when the window sash 12 is raised outside the window slot 20 and above the overall casing structure of the window air conditioning unit 18, as shown in FIG. 1, and the second position of the window assembly 10 may be when the window sash 12 is lowered inside the window slot 20 and rests on the top or surface of the retention bracket 30 or second bracket 32, as shown in FIG. 2.

In some embodiments, after placing the window air conditioning unit 18 on the top of the main mounting bracket 24, if used, or windowsill 14, the window sash 12 may be pulled down into the window slot 20 to help to align the window air conditioning unit 18 in the correct location. The window sash 12 inserted into the window slot 20 may also help to support the window air conditioning unit 18 during installation of the retention bracket 30, or portions thereof.

Although not shown, in some implementations the retention bracket 30, or portions thereof, may be integral with one or more portions of the window air conditioning unit 18. For example, the first bracket 31, or portions thereof, may be integral with unit 18 or window slot 20. In other embodiments, the second bracket 32 may be integral with unit 18 or window slot 20. In some embodiments, both the first bracket 31 and the second bracket 32 may be integral with unit 18 or window slot 20.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein, unless characterized otherwise, are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the disclosure to the precise steps and/or forms disclosed, and obviously many modifications and variations are possible in light of the above teaching. It is intended that the scope of the disclosure and all equivalents be defined by the claims appended hereto.

The invention claimed is:

1. A retention bracket for securing a window air conditioning unit in a window assembly, the window assembly having at least one vertically operable window sash, a horizontal windowsill, and two vertical side window tracks, the window air conditioning unit having a window slot therewithin separating an indoor portion from an outdoor portion, wherein the window slot is for receiving the at least one vertically operable window sash, the retention bracket comprising:

at least one first bracket comprising a first end and a second end, wherein the first end and the second end of the at least one first bracket are configured to be received within the vertical side window track to provide support to the window air conditioning unit, wherein the at least one first bracket is positioned between the window slot of the window air conditioning unit and the windowsill; and at least one second bracket comprising a first end and a second end, wherein the at least one second bracket is positioned in the window slot of the window air conditioning unit, and wherein the first end and the second end of the at least one second bracket is affixed to the at least one first bracket.

2. The retention bracket of claim 1 wherein the first end and the second end of the at least one second bracket is affixed to the at least one first bracket between the window track and the window slot.

3. The retention bracket of claim 1 wherein the first end and the second end of the at least one second bracket is affixed to the at least one first bracket via one or more fasteners.

4. The retention bracket of claim 3 wherein the one or more fasteners engages the windowsill of the window air conditioning unit.

5. The retention bracket of claim 1 wherein the first end and the second end of the at least one second bracket is affixed to the window track via one or more fasteners.

6. The retention bracket of claim 1 wherein the first end and the second end of the at least one first bracket includes a projection extending for a length in the window track of the window air conditioning unit.

7. The retention bracket of claim 6 wherein the projection extends upwardly within the window track of the window air conditioning unit.

8. The retention bracket of claim 1 wherein the at least one first bracket is adjustable in length.

9. The retention bracket of claim 8 wherein the at least one first bracket includes a base having a track guide slidably receiving at least one of the first end and/or the second end of the at least one first bracket.

10. The retention bracket of claim 9 wherein the track guide slidably receiving both of the first end and the second end of the at least one first bracket.

11. The retention bracket of claim 1 in combination with the window air condition unit.

12. A method of securing a window air conditioning unit in a window assembly, the window assembly having at least one vertically operable window sash, a horizontal windowsill, and two vertical side window tracks, the window air conditioning unit having a window slot therewithin separating an indoor portion from an outdoor portion, wherein the window slot is for receiving the at least one vertically operable window sash, the method comprising:

providing a retention bracket having a first bracket and a second bracket, wherein each one of the first bracket and the second bracket includes a first end and a second end;

raising the window sash to a first position and installing the first bracket;

inserting the first end and the second end of the first bracket into the vertical side window track;

positioning the window air condition unit onto the first bracket;

providing the second bracket in the window slot of the window air conditioning unit;

affixing at least one of the first end and/or the second end of the second bracket to the first bracket; and lowering the window sash to a second position.

13. The method of claim 12 wherein the first position is when the window sash is outside the window slot, and the second position is when the window sash is inside the window slot.

14. The method of claim 12 adjusting a length of the first bracket to engage the first end and the second end of the first bracket to the vertical side window track.

15. The method of claim 14 wherein the first bracket includes a base having a track guide slidably receiving at least one of the first end and/or the second end of the first bracket to adjust the length of the first bracket.

16. The method of claim 12 further comprising affixing the first end and the second end of the first bracket to the vertical side window track.

17. The method of claim 12 further comprising affixing the first end and the second end of the second bracket to the first bracket.

18. The method of claim 17 wherein the first end and the second end of the second bracket is affixed to the first bracket between the vertical side window track and the window slot.

19. The method of claim 17 further comprising affixing the first end and the second end of the second bracket to the windowsill.

20. The method of claim 12 further comprising installing a main mounting bracket and placing the window air conditioning unit onto the main mounting bracket.

21. A retention bracket for securing a window air conditioning unit in a window assembly, the window assembly having at least one vertically operable window sash, a horizontal windowsill, and two vertical side window tracks, the window air conditioning unit having a window slot therewithin separating an indoor portion from an outdoor portion, wherein the window slot is for receiving the at least one vertically operable window sash, the retention bracket comprising:

at least one first bracket comprising a first end and a second end, wherein the first end and the second end of the at least one first bracket are configured to be received within the vertical side window track to provide support to the window air conditioning unit, wherein the at least one first bracket is positioned between the window slot of the window air conditioning unit and the windowsill;

at least one second bracket comprising a first end and a second end, wherein the at least one second bracket is positioned in the window slot of the window air conditioning unit, and wherein the first end and the second end of the at least one second bracket is affixed to the at least one first bracket; and wherein the window air conditioning unit allows the window assembly to be adjustable between a first position and a second position.

22. The retention bracket of claim 21 further comprising a main mounting bracket.

23. The retention bracket of claim 21 wherein the first position is when the window sash is outside the window slot and the second position is when the window sash is inside the window slot.

* * * * *